US010035274B2

(12) United States Patent
Godlieb

(10) Patent No.: US 10,035,274 B2
(45) Date of Patent: Jul. 31, 2018

(54) ELECTRIC SHAVER WITH A CLEANING INDICATOR

(71) Applicant: KONINKLIJKE PHILIPS N.V., Eindhoven (NL)

(72) Inventor: Robert Godlieb, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 38 days.

(21) Appl. No.: 15/318,210

(22) PCT Filed: May 27, 2015

(86) PCT No.: PCT/EP2015/061757

§ 371 (c)(1),
(2) Date: Dec. 12, 2016

(87) PCT Pub. No.: WO2015/193072

PCT Pub. Date: Dec. 23, 2015

(65) Prior Publication Data

US 2017/0113360 A1 Apr. 27, 2017

(30) Foreign Application Priority Data

Jun. 20, 2014 (EP) ..... 14173301

(51) Int. Cl.
*B26B 19/38* (2006.01)

(52) U.S. Cl.
CPC ..... *B26B 19/388* (2013.01); *B26B 19/3853* (2013.01)

(58) Field of Classification Search
CPC ..... B26B 19/388; B26B 19/3853
USPC ..... 30/41.7
See application file for complete search history.

(56) References Cited

U.S. PATENT DOCUMENTS 5,111,580 A 5/1992 Bosscha
5,274,735 A 12/1993 Okada
5,367,599 A * 11/1994 Okada ..... B26B 19/28 388/809
5,600,888 A * 2/1997 Becker ..... B26B 19/00 30/41.7
5,920,988 A 7/1999 Momose
(Continued)

FOREIGN PATENT DOCUMENTS

EP 0895835 A2 2/1999
JP 11-47463 * 2/1999
JP 4059578 * 12/2007

*Primary Examiner* — Hwei C Payer

(57) ABSTRACT

The invention relates to an electric shaver (1) comprising a cutter unit (3), an electric motor (4) arranged to drive the cutter unit (3), a load detector (14) arranged to measure at least one electric parameter indicative of a power consumption of the motor (4) to obtain a measured value. An idle load calculator (16) receives one or more of the measured values measured at different instances during an idle period of the shaver. The idle load calculator calculates an idle load value using the one or more measured values, and stores the calculated idle load value in a memory (17). A threshold calculator (18) determines a cleaning threshold value. A comparator (19) generates a cleaning signal if an idle load value for the current shaving session exceeds the cleaning threshold value. An alerter (8) receiving the cleaning signal produces an alert indicating to a user that the cutter unit of the shaver should be cleaned.

13 Claims, 4 Drawing Sheets

(56) References Cited

U.S. PATENT DOCUMENTS

| | | | | |
|---|---|---|---|---|
| 6,072,399 | A | 6/2000 | Cimbal | |
| 6,189,215 | B1 * | 2/2001 | Beerwerth | A45D 27/46<br>30/32 |
| 9,114,542 | B2 * | 8/2015 | Vetter | B26B 19/388 |
| 2005/0144784 | A1 * | 7/2005 | Ibuki | B26B 19/28<br>30/41 |
| 2011/0197455 | A1 | 8/2011 | Vetter | |
| 2017/0019044 | A1 * | 1/2017 | Godlieb | B26B 19/388 |
| 2017/0113360 | A1 * | 4/2017 | Godlieb | B26B 19/388 |

* cited by examiner

ELECTRIC SHAVER WITH A CLEANING INDICATOR

This application is the U.S. National Phase application under 35 U.S.C. § 371 of International Application No. PCT/EP2015/061757, filed on May 27, 2015, which claims the benefit of International Application No. 14173301.4 filed on Jun. 20, 2014. These applications are hereby incorporated by reference herein.

FIELD OF THE INVENTION

The invention relates to household appliances and more particularly to an electric shaver.

BACKGROUND OF THE INVENTION

In electric shavers the shaving heads or cutter units get filled and polluted with the debris of shaving. Especially when a shaver is used with shaving cream or some other pre-shave additive applied to the face, this additive collects in the shaving heads or cutter units. Higher-end shavers often comprise a cleaning indicator. This is a symbol or user interface element that will activate, e.g. light up, to alert the user of the need to clean the shaver, in particular the shaving heads or cutter units.

The user interaction of known cleaning indicators in shavers is generally uniform, i.e. the cleaning indicator behaves in a similar way for all users and uses. Known cleaning indicators are generally activated based on time. They are for example activated after a predetermined number of minutes of shaving time or a predetermined number of shaving sessions. In some known shavers the cleaning indicator is even activated after every shaving session to prompt the user to clean.

With the above described known cleaning indicators, in the perception of the user the cleaning indicator provides a fairly arbitrary alert. This leads to an overall lower credibility of the shaver and less appreciation. When prompting the user to clean after every shaving session, the cleaning indicator is even unnecessarily burdening the user by negating the fact that the hair-chamber of the shaver is especially designed to accommodate the hairs and debris of several shaving sessions, and thereby loses credibility. When a user is prompted to clean after every shaving session, the user is burdened with the extra work of regular cleaning and does not experience a direct benefit from the presence of the cleaning indicator.

Patent publication U.S. Pat. No. 5,274,735 describes an electric shaver comprising a motor, a microcomputer and a current detecting circuit which detects the electrical current in the motor. The microcomputer is arranged to read, after the rotational speed of the motor has stabilized after start-up, a digital value outputted from an A/D converting circuit, and compare this value with a predetermined value set beforehand. When the detected motor current value is larger than the predetermined value, the microcomputer judges that an accumulated amount of shaving debris is increasing, and outputs a predetermined alert demanding cleaning of the shaver to a display of the shaver.

Nowadays, shavers are manufactured that may be used with different cutter units on a single main body. Storing a single predetermined value in such a shaver and comparing the actual motor current with the predetermined value, as is done by the shaver known from U.S. Pat. No. 5,274,735, may provide reliable cleaning alerting signals for just a single, individual cutter unit. But due to the power consumption variations between individual cutter units as well as the drift over time of the power consumption of an individual cutter unit, it will not be possible to provide reliable cleaning alerting signals using the technique used in the shaver known from U.S. Pat. No. 5,274,735.

SUMMARY OF THE INVENTION

It is an object of the invention to provide a shaver that provides a more reliable cleaning alerting signal as compared to known shavers.

According to the present invention, this object is achieved by an electric shaver comprising a cutter unit, an electric motor arranged to drive the cutter unit, and a load detector arranged to measure at least one electric parameter indicative of a power consumption of the electric motor to obtain a measured value. The shaver also comprises a memory, an idle load calculator, a threshold calculator, a comparator and an alerter. The idle load calculator is arranged to receive one or more measured values measured at different instances during an idle period of the shaver, in which the shaver is switched on but not shaving. The idle load calculator is arranged to calculate an idle load value using the one or more measured values, and store the calculated idle load value in the memory. The memory may be a non-volatile memory, so that the calculated idle load values can be read even after powering off the shaver. The threshold calculator is arranged to read N idle load values from the memory relating to N previous shaving sessions, where N is a positive integer, and calculate a cleaning threshold value using the N idle load values. The comparator is arranged to receive the idle load value for a current shaving session, and generate a cleaning signal if the idle load value for the current shaving session exceeds the cleaning threshold value. The alerter is arranged to receive the cleaning signal from the comparator and produce an alert indicating to a user that the cutter unit of the shaver should be cleaned.

By comparing the idle load value for the current shaving session with the cleaning threshold value, which is calculated on the basis of the idle load values measured for a number of previous shaving sessions, the generation of the cleaning signal is dependent on the idle load values of the previous shaving sessions, which may vary for individual shavers and/or individual cutter units. In this manner, the detection of a change in the power consumption of the motor due to the presence of hairs and shaving debris in the cutter unit and the providing of a cleaning alert based thereon becomes fact-based rather than time-based. This results in a higher-quality appliance and allows for the alert given to be more clear (not 'ignorable') and effective. By keeping time history of the measured values, the shaver can in practice perform a reliable detection of the degree of pollution of the cutting units, and the detection is robust for the drift over time of the power consumption of the shaver and for the variations of the power consumption when using different cutter units within the same shaver.

In an embodiment of the electric shaver according to the invention, the comparator is arranged to generate a recalculate signal if the idle load value for the current shaving session does not exceed the cleaning threshold value, wherein the threshold calculator is arranged to receive the recalculate signal and, upon receipt thereof, read K idle values from the memory relating to K previous shaving sessions, and to recalculate the cleaning threshold value using the K idle values, wherein K is a positive integer greater than N.

In an embodiment of the electric shaver according to the invention, the idle load calculator is arranged to average the one or more measured values measured during the idle period of the shaver to obtain the idle load value.

In an embodiment of the electric shaver according to the invention, the idle period of the shaver is a predetermined period starting when the electric motor is switched on. In a further embodiment, the idle period of the shaver is a predetermined period starting at a point in time after the motor is switched on and after an initial start-up peak of the power consumption of the electric motor.

In an embodiment of the electric shaver according to the invention, the shaver comprises a cleaning detector arranged to detect whether the cutter unit has been cleaned and, if so, send a reset signal to the threshold calculator. In a further embodiment, the cleaning detector is arranged to compare the calculated idle load value of the current shaving session and the calculated idle load value of an immediately preceding shaving session with the cleaning threshold value, and send the reset signal to the threshold calculator if both the calculated idle load value of the current shaving session is lower than the cleaning threshold value and the calculated idle load value of the immediately preceding shaving session is above the cleaning threshold value.

In an embodiment of the electric shaver according to the invention, the threshold calculator is arranged to calculate the cleaning threshold value using the formula $$CL_TH=(1+F)\times \mathrm{Aver}(N_\mathrm{idle_values})$$

wherein

CL_TH corresponds to the cleaning threshold value

F is a factor in a range of 0.0-1.0

Aver( ) is an averaging function

N_idle_values corresponds to the N idle load values from the memory relating to N previous shaving sessions.

In a further embodiment, the factor F is in a range from 0.1 to 0.2, and in a particular embodiment the factor F is equal to 0.12. In an embodiment, N is equal to 3. Other values for N may be chosen, such as 4 or larger than 4.

In a further embodiment of the electric shaver according to the invention, the shaver comprises a microprocessor comprising the idle load calculator, the threshold calculator and the comparator. In this embodiment, the idle load calculator, the threshold calculator and the comparator may be suitably programmed modules running on the microprocessor. This software implementation is easy to manufacture using hardware already present in most modern shavers.

The electric shaver according to the invention may be e.g. a razor or a trimmer.

Further preferred embodiments of the device according to the invention are given in the appended claims.

BRIEF DESCRIPTION OF THE DRAWINGS

These and other aspects of the invention will be apparent from and elucidated further with reference to the embodiments described by way of example in the following description and with reference to the accompanying drawings, in which.

The figures are purely diagrammatic and not drawn to scale. In the Figures, elements which correspond to elements already described may have the same reference numerals.

DETAILED DESCRIPTION OF EMBODIMENTS

Figure 1:
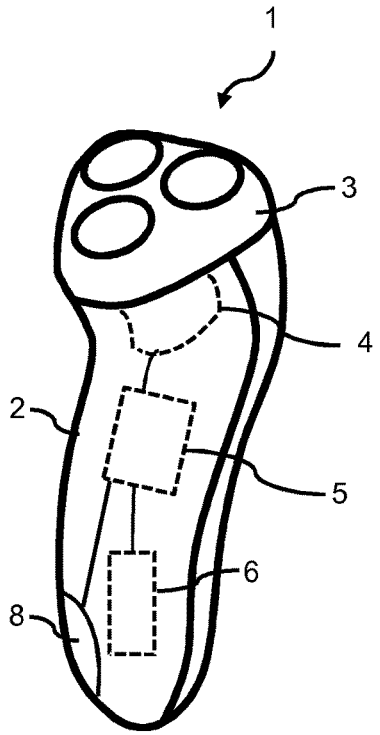
FIG. 1 is a perspective view of a shaver according to an embodiment of the invention.

FIG. 1 is a perspective view of a shaver 1 according to an embodiment of the invention. The shaver 1 comprises a housing 2 and a cutter unit 3. Inside the housing an electric motor 4 is located which is arranged to drive the cutter unit 3. In this example, the cutter unit 3 comprises three shaving heads and associated hair chambers (not shown). A control circuitry 5 and a battery 6 are also located in the housing 2. The shaver 1 also comprises an alerter 8 arranged to produce an alert indicating to a user that the cutter unit 3 of the shaver 1 should be cleaned. The alerter 8 may be a display showing an indicator, such as a flashing light. Alternatively, the alerter 8 may be arranged to give audio feedback or haptic feedback to the user.

Figure 2:
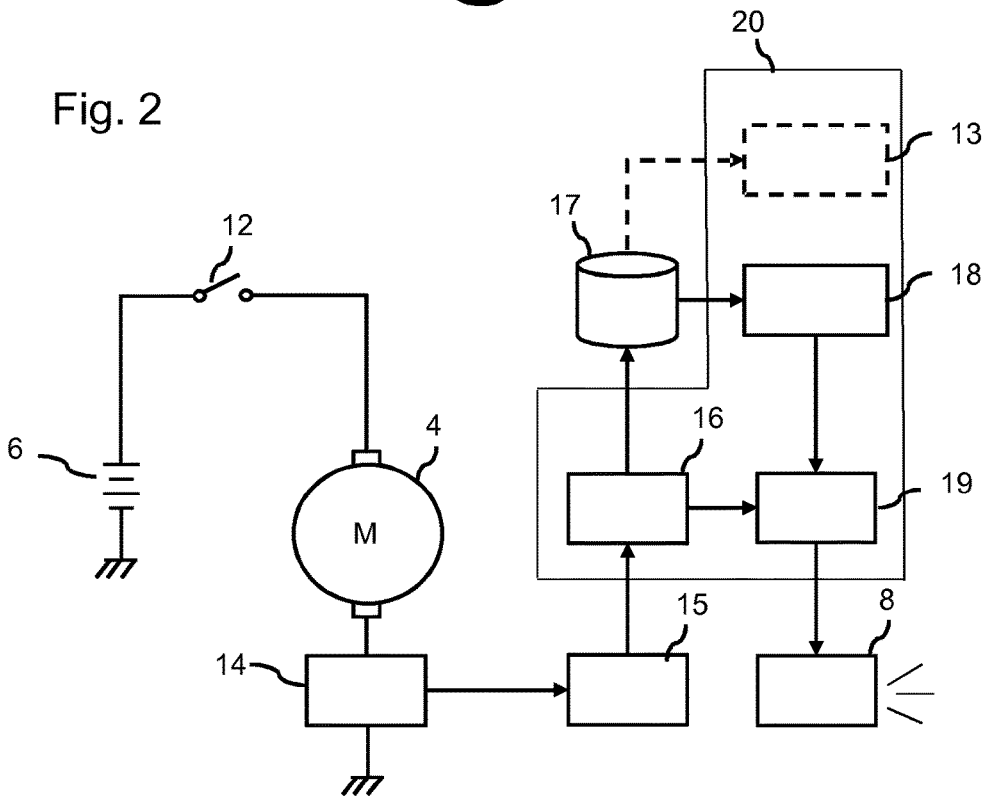
FIG. 2 schematically shows electric components of the shaver of the embodiment of FIG. 1.

FIG. 2 schematically shows electric components of the shaver 1 of the embodiment of FIG. 1. As can be seen from FIG. 2, the battery 6 is connected to the motor 4 via an ON/OFF switch 12. The battery 6 may provide a voltage between 3.7 and 4.4 Volt, but other values are possible such as 1.2 or 1.5 Volt. The battery may be a rechargeable battery.

The shaver 1 also comprises a load detector 14 arranged between the motor 4 and ground. Furthermore, the shaver 1 comprises an AD converter 15, an idle load calculator 16, a memory 17, a threshold calculator 18 and a comparator 19. The load detector 14, the AD converter 15, the idle load calculator 16, the memory 17, the threshold calculator 18 and the comparator 19 are parts of the control circuitry 5 shown in FIG. 1.

The load detector 14 is arranged to measure an actual power consumption of the motor 4 by way of measuring a load current, to obtain a measured value. The current through the motor 4, also referred to as load current, can be used as a sensed input parameter for the AD converter 15. A more refined method would be to calculate the power consumption of the motor by measuring both the current through the motor 4 and the voltage across the motor 4, however, given the flat characteristic of the motor 4, the current through the motor 4 is a good enough parameter to determine the actual power consumption.

In an embodiment, the AD converter 15 is arranged to receive an actual motor current from the load detector 14 and convert received analogue values into digital values. The idle load calculator 16 is arranged to receive one or more of the measured values measured at different instances during an idle period of the shaver 1. The measured value may be a digital value received from the AD converter 15 or an analogue value directly received from the load detector 14. The idle load calculator 16 is arranged to calculate an idle load value using the one or more measured values, and store the calculated idle load value in the memory 17. In this way an idle-values history may be stored and made available. In case the memory 17 is a non-volatile memory, the idle values will be available also after the shaver has been completely powered off.

Figure 3:
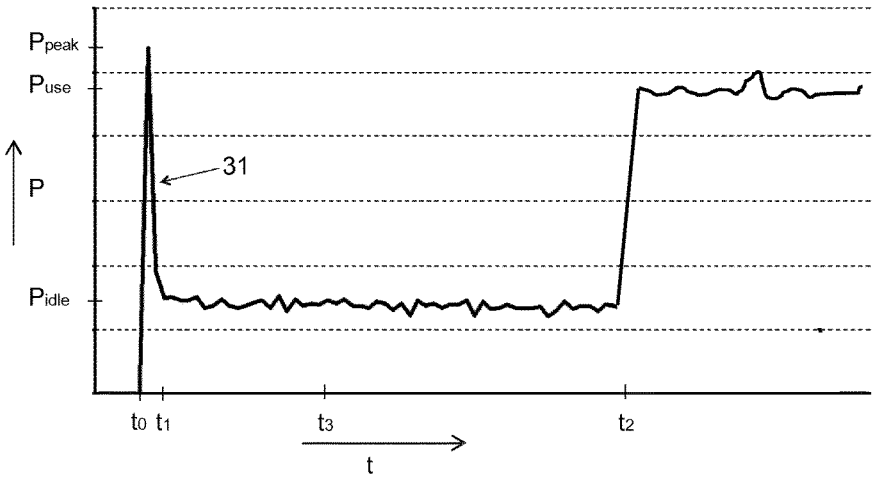
FIG. 3 shows a graph of a measured power consumption P as a function of time t of the electric motor of a shaver according to a further embodiment of the invention.

FIG. 3 shows a graph of a measured power consumption P as a function of time t for a shaver according to an embodiment. As can be seen from FIG. 3, the power consumption P reaches a peak 31 with a maximum value $P_{peak}$ immediately after start-up at t0 of the motor, i.e. between t0 and t1, after which it settles to an idle value $P_{idle}$. When the user starts shaving at point t2, the power consumption increases to a level $P_{use}$. The period between t0 and t2 in which the shaver 1 is switched on, but not shaving, is referred to as the idle period. In the example of FIG. 3 t2=2 sec.

When the cutter unit 3 is clean, the power consumption during the idle period in fact fluctuates around the idle value $P_{idle}$. By measuring the power consumption P over a period of time after switch-on of the motor, e.g. the time period from t0 to t3 after the switch-on, and applying an averaging algorithm (average or average after removing n outliers), a reproducible value can be measured. It is noted that the initial start-up period (in this example the period between t0 and t1) may be omitted from the averaging process because this initial time period shows the start-up behavior of the motor (inrush), rather than the load experienced. The value for t1 may be for example 200 ms and for t3 for example 600 ms. Practical values for t3 may lie between 400 ms and 3 sec depending on the expected use of the shaver. It is assumed that the user will activate the shaver 3 before the cutting unit 3 makes contact with a beard or another part of the body.

In order to know when the power consumption has settled at the idle value $P_{idle}$ different techniques could be used. A graph could be made of the power consumption as a function of time (such as FIG. 3), and from that graph a shaver manufacturer can find a suitable time period (e.g. t1-t0) after which it can be concluded that the power consumption has settled to a specific level. Alternatively, samples could be taken from the power consumption, and deviations can be calculated. If the deviation of e.g. the last 5 samples is within certain limits, such as less than 12% of a nominal idle value, than it could be concluded that the power consumption has settled at the requested level.

As hair chambers in the cutter unit 3 are filled with debris, the running resistance experienced by the cutter unit 3 increases. This results in a higher power consumption of the motor 4.

The idle load calculator 16 is arranged to receive one or more measured values of the power consumption measured at different instances during the idle period of the shaver 1. The idle load calculator 16 is arranged to calculate an idle load value using the one or more measured values, and store the calculated idle load value in the memory 17. In an embodiment, the idle load calculator 16 is arranged to average multiple measured values of the power consumption measured at different instances during the idle period of the shaver to obtain the idle load value.

Figure 4:
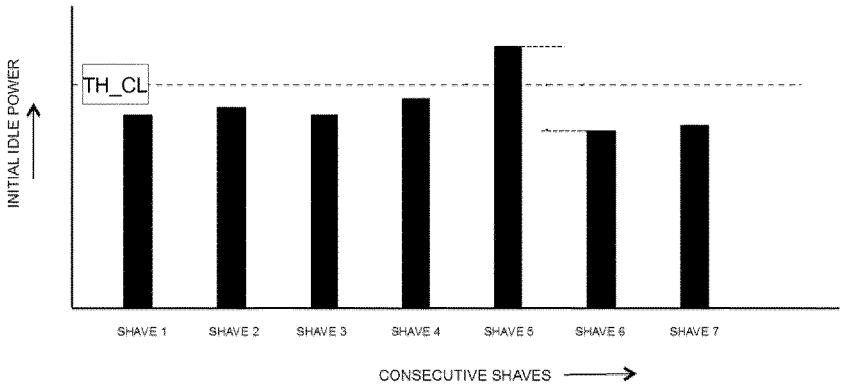
FIG. 4 shows a graph of the measured power consumption $P_{idle}$ during the idle period of a shaver according to the invention for seven consecutive shaving sessions.

FIG. 4 shows a graph of the (average) measured power consumption $P_{idle}$ during the idle period (i.e. the idle load value) for seven consecutive shaving sessions, using the shaver 1 as described above.

In an embodiment, the threshold calculator 18 is arranged to read N idle load values from the memory 17 relating to N consecutive shaving sessions, where N is a positive integer. Instead of using N consecutive shaving sessions, a number of previous shaving sessions can be used wherein the shaving sessions actually are not consecutive, but are just N sessions out of an array of previous shaving sessions. The threshold calculator 18 will calculate a cleaning threshold value using the N idle values. In an embodiment, the first 3 idle load values are used to calculate the cleaning threshold value. For example, an average of the first 3 idle load values can be calculated, which average is increased by a certain percentage to obtain the cleaning threshold value. In FIG. 4 this cleaning threshold value is indicated by a dashed horizontal line TH_CL.

The comparator 19 is arranged to receive the idle load value for a current $K^{th}$ shaving session, with K equal to N+1, N+2 . . . . So if N is e.g. equal to 3, then K has values equal to or greater than 4. The comparator 19 is further arranged to generate a cleaning signal if the idle load value for the current $K^{th}$ shaving session exceeds the cleaning threshold value. In the example of FIG. 4, the cleaning threshold value is exceeded at the fifth shaving session, see SHAVE 5.

The alerter 8 will receive the cleaning signal from the comparator 19 and will produce an alert indicating to a user that the cutter unit 3 of the shaver 1 should be cleaned.

It is noted that individual measurements of the (average) power level of the shaver 1 will not give a meaningful value to make any statement about the rate of pollution. The per-specimen variation in power level between shavers and differences between individual users are too large, relative to the power-increase due to progressive pollution, to be useful. However, by measuring the (average) power consumption of N previous shaving sessions and storing these values, it becomes possible to use the power level as a proxy measurement of pollution. Note that there is not a linear, proportional correlation between measured power levels and the level of pollution of the shaver.

The idle load values of several shaving sessions and knowledge of the correlation are used to give a correct cleaning alert when the shaver really does need cleaning. Taking into account a series of idle power level measurements, a nominal idle-power level of the shaver 1 can be determined. The absolute value of this nominal level will vary between shavers and specific cutting units used in combination with the shavers, but by performing this series of measurements over a number of previous shaves the correct idle-power level of that particular shaver and cutter unit can be determined. The measured values of the idle load value will have a small variation, in the order of 6%, from measurement to measurement.

In an embodiment, a cleaning alert is produced when an idle-power level is detected that exceeds the variation as detected in the preceding shaving sessions. In an alternative embodiment, a cleaning alert is produced when an idle-power level exceeds the calculated average load value by a certain percentage. In an embodiment, the threshold calculator 18 is arranged to calculate the cleaning threshold value using the formula:

$$CL_TH=(1+F)\times \mathrm{Aver}(N_\mathrm{idle_values}) \quad (1)$$

wherein

CL_TH corresponds to the cleaning threshold value

F is a factor in a range of 0.0-1.0

Aver( ) is an averaging function

N_idle_values corresponds to the N idle values from the memory relating to N previous shaving sessions.

In an embodiment, the factor F lies in the range from 0.1 to 0.2. A practical value for the factor F is 0.12. Such values gave satisfying results during testing, but it is noted that other values are conceivable such as values above 0.2.

The electric shaver 1 may further comprise a cleaning detector 13, see FIG. 2, arranged to detect whether the cutter unit 3 has been cleaned and, if so, send a reset signal to the threshold calculator 18. The cleaning detector 13 may be arranged to compare the calculated idle load value of a current shaving session and the calculated idle load value of an immediately preceding shaving session with the cleaning threshold value, and to send the reset signal to the threshold calculator 18 if both the calculated idle load value of the current shaving session is lower than the cleaning threshold value and the calculated idle load value of the immediately preceding shaving session is above the cleaning threshold value.

FIG. 4 shows a situation wherein the calculated idle load value of the sixth shaving session is lower than the cleaning threshold value. The calculated idle load value of the immediately preceding shaving session (i.e. the fifth shaving session) was above the cleaning threshold value, see FIG. 4. Thus, it may be concluded that the user has cleaned the cutter unit 3.

In a particular embodiment, the shaver 1 comprises a microprocessor 20, see FIG. 2, which comprises the idle load calculator 16, the threshold calculator 18 and the comparator. Optionally, the processor 20 also comprises the AD converter 15 and/or the cleaning detector.

Figure 5:
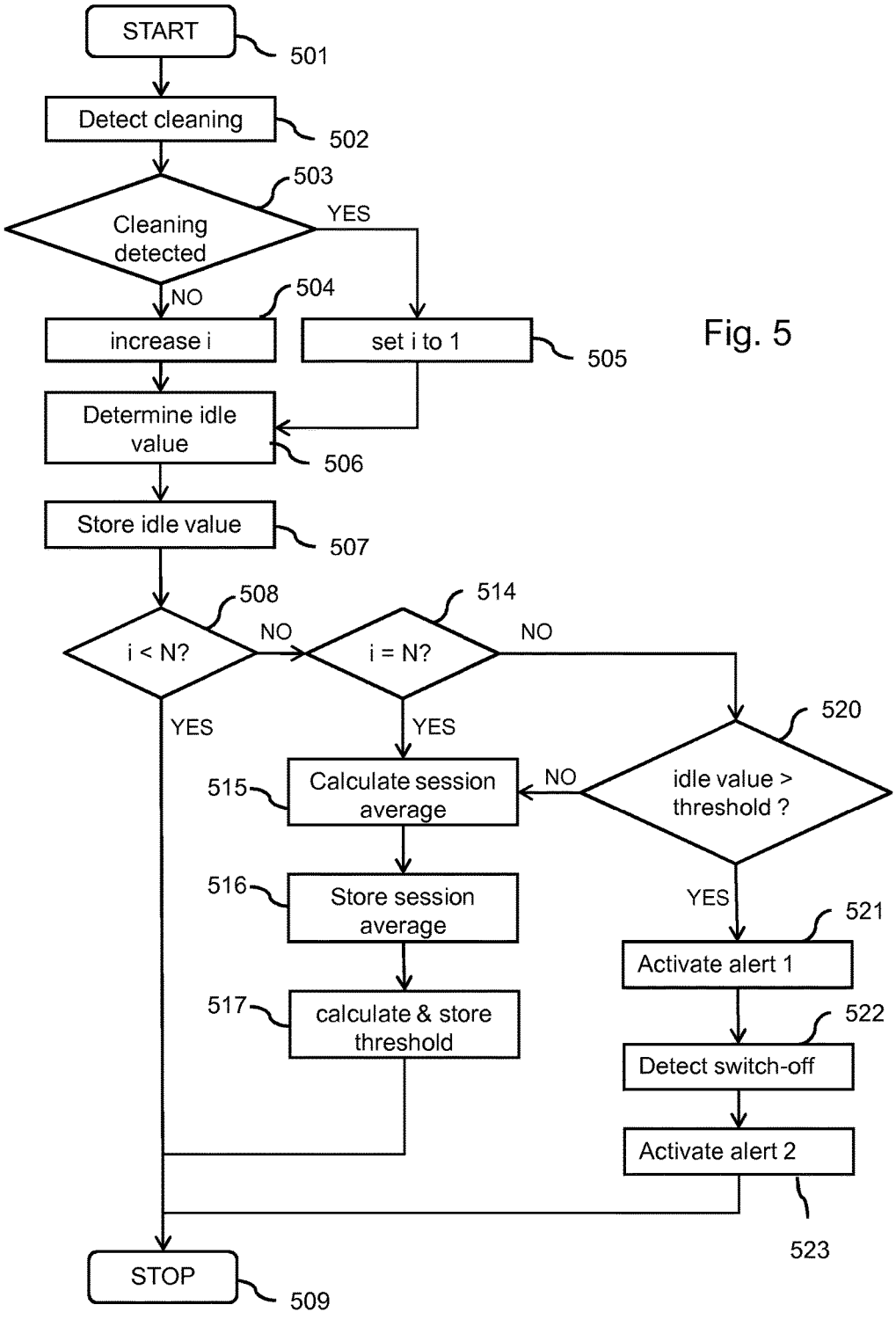
FIG. 5 shows a flowchart of an example of the processing steps performed by the microprocessor of a shaver according to the invention.

In an embodiment, the microprocessor 20 is arranged to perform a method to produce the cleaning signal for the alerter 8. FIG. 5 shows a flowchart of an example of the processing steps performed by the microprocessor 20.

After a start 501, a "detect cleaning" step 502 is performed as may be performed by the cleaning detector 13 described above. If cleaning of the cutter unit 3 is not detected, see test 503, a session counter i is increased, see step 504. Otherwise, the session counter i is set to 1, see step 505. Next, in a step 506, the idle load value is determined for the current shaving session, and stored in the memory 17, see step 507.

In a subsequent test 508, it is tested if the session counter i is smaller than a value N, where N is an integer, for example equal to 3. If the session counter i is smaller than the value N, the method stops at 509 and no alert is activated. The shaving session will continue without alerting the user.

If, however, i is not smaller than N, then it is tested in test 514 if i is equal to N. If i is equal to N, a step 515 is performed to calculate the session average using the stored idle load values. The session average is stored in the memory 17, see step 516. In a following step 517, the cleaning threshold value is calculated using the average session value. The cleaning threshold is then stored in the memory. The steps 515, 516 and 517 can be regarded as a calibration process using N shaving sessions to calibrate the value for the cleaning threshold.

If in step 514 it is concluded that i is larger than N (e.g. larger than 3), it is tested in test 520 if the idle load value is larger than the threshold. In case the idle load value is larger than the threshold, a step 521 follows in which a first alert signal is produced and sent to the alerter 8 to alert the user. The first alert signal is produced during the shaving session. When the user switches off the shaver, the microprocessor will detect the switch-off, see step 522. After detection of the switch-off, a further alert, see step 523, is produced by sending a second alert signal to the alerter 8. The second alert signal may cause the alerter 8 to produce a different signal as compared to the one caused by the first alert signal. For example, an audible signal may be produced during the particular shaving session, while at the end of the session only a visual signal may be produced. Other variants are possible, such as first a short audio signal and later on a permanent audio signal, possibly combined with appropriate visual signals.

If, in test 520, the idle load value is not larger than the cleaning threshold, there will not be an alert, and steps 515, 516 and 517 will be executed. In this way the threshold will be recalculated, even after the original calibration process using the N shaving sessions. Recalculation of the cleaning threshold may improve the value for the threshold, taking into account e.g. long term wear of a shaving unit. Over its lifetime a shaving unit is subject to wear and thus its nominal idle value may shift gradually. By recalculating the cleaning threshold in the manner described, the threshold remains relative to the nominal idle value over the shaver and shaving unit lifetime. Likewise, the recalculating of the threshold ensures that the cleaning alerts remain correct and relevant also when e.g. a new shaving unit is purchased by the user as a replacement for the shaver.

On first use of the shaver 1, the idle-values history in the memory 17 is empty. In the case of first-use, the idle load values are deemed to be nominal, i.e. not requiring cleaning. After an initial set of a small number (i.e. N) of idle load measurements, the cleaning threshold is deemed to be valid (i.e. useful). As mentioned above, for this initialization or learning period, a good value for N is 3 shaving sessions.

In an embodiment of FIG. 5, after the initialization period, a measured idle load value is added to the memory 17, see step 507. Only when the idle load value does not exceed the threshold, it is deemed to be part of the calculation of the average and a value to refine the threshold, see test 520 followed by steps 515, 516 and 517. An idle load value that exceeds the criteria does not affect the criteria for triggering a cleaning alert, but will instead activate a cleaning alert.

As mentioned above, a cleaning event can be detected sufficiently reliably by comparing the calculated idle load value of the current shaving session and the calculated idle load value of an immediately preceding shaving session to the cleaning threshold value. Alternatively, a cleaning event could also be detected by a drop in the whole power level for a full shave. If the shaver is made such that it also calculates and stores the overall average power level of a shave (of e.g. 3 minutes), then a cleaned unit will show a drop in this value that exceeds a practical threshold. This change of the average power level of a whole shave is a bit more pronounced when it drops than when it rises.

As an illustration for a particular shaver with a shaving unit, the idle value of a clean cutter unit averages around 1.4 W. During shaving, the shaving heads can initially discharge the debris into the hair chamber and consequently the idle-power level rises only marginally. As, however, the hair chamber reaches its limit, the shaving heads can no longer discharge into the hair chamber, start to impede the cutters (and hinder the shaving function) and the idle power levels increase measurably to an average of 1.6 W. This increase of 0.2 W is larger than, and distinct from, the natural variations over time of the idle power of previous shaves as the hair chamber gradually fills.

The described embodiments enable the shaver to more accurately determine the cleaning events and the need for a cleaning as compared to the known shavers. As a result, the user alerts can be designed to be more explicit and effective.

Especially the alerts of state of the art shavers, which are given every shave, must not be too noticeable or prominent. These frequent alerts have to be 'ignorable'. In the case of a cleaning indicator whose indication is determined by the need to clean as in the described embodiments, these alerts can be more prominent, such as larger and louder visual alerts, but also e.g. a sound signal at the start of a shave, or a shaver motor hesitation or pattern to catch the attention of the user.

Optionally, a cleaning alert is given immediately after the initial idle-value has been determined and checks have been done. This can be chosen to be a relatively subdued alert. The alert after the shave can be chosen to be of a more explicit nature.

It is noted that the cleaning alert given immediately after the initial idle value has been determined will have a useful function, because at that moment the user is engaged with the function of shaving and will have attention for the quality of the shave. Additionally, the difference in performance between shaving with a full hair chamber and a cleaned hair chamber will be more clearly experienced by the user, leading to an immediate, positive affirmation of the relevance of the appliance alerts.

Figure 6:
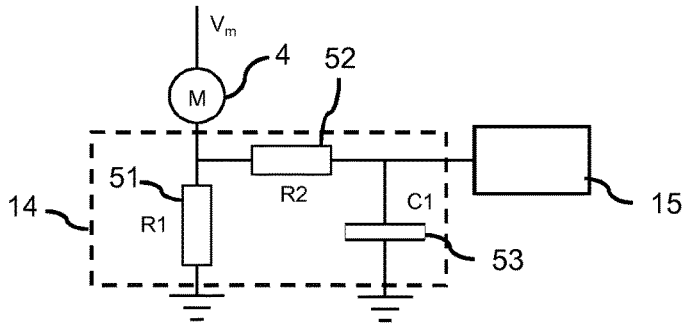
FIG. 6 shows an example of the load detector together with the motor and the AD converter of a shaver according to the invention, and FIG. 7 schematically shows part of a further embodiment in which an electronically commutated brushless motor is arranged in the shaver according to the invention.

FIG. 6 shows an example of the load detector 14 together with the motor 4 and the AD converter 15. The load detector 14 comprises a first resistor 51 coupled between the motor 4 and ground, a second resistor 52 coupled to the motor 4 and an input of the AD converter 15. Between the input of the AD converter 15 and ground, a capacitor 53 is coupled. The AD converter 15 will receive a voltage that directly relates to the current flowing through the resistor 51 and thus to the current flowing through the motor 4, assuming the second resistor 52 is large enough. The second resistor 52 and the capacitor 53 together form a low-pass filter. Adding this filter will help establish a stable current measurement and will help avoid an audible acoustic 'whine' from the appliance. Practical values for the first resistor 51, the second resistor 52 and the capacitor 53 are R1=0.5 Ohm, R2=1000 Ohm, C1=10 microfarad at an average motor voltage Va in a range between 3.7 to 4.2 Volt. The AD converter 15 is arranged to sample the voltage values received and convert them into digital values to be processed by the processor 16. The AD converter 15 may be a separate device but it may alternatively be integrated into a single processor together with the processor 16.

Figure 7:
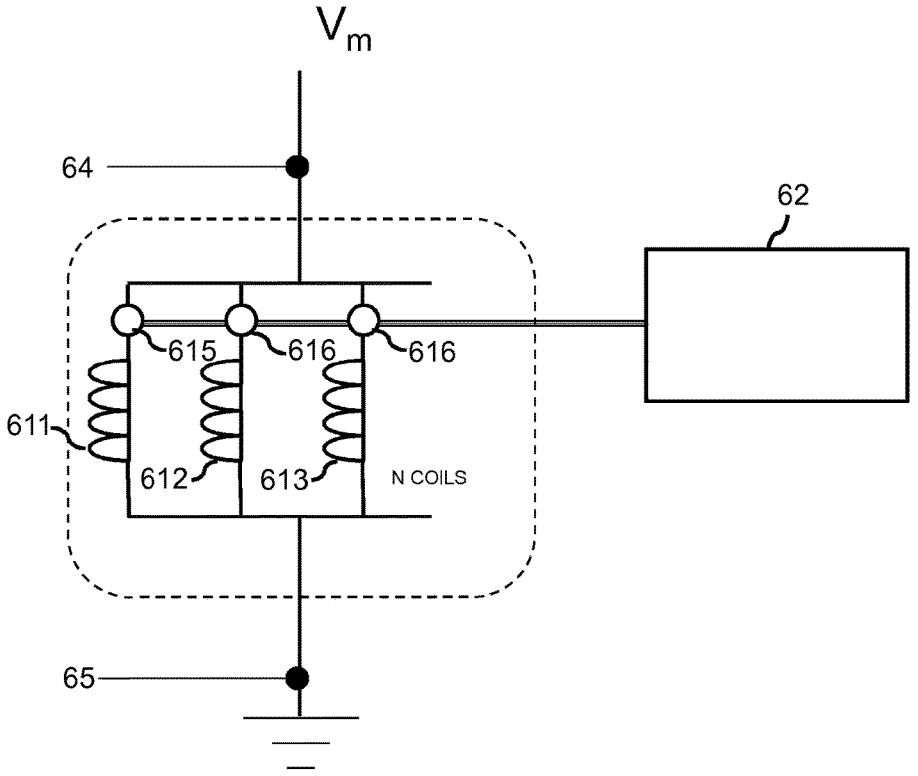

The embodiment described with reference to FIG. 2 may apply to a brushed DC motor that is controlled by PWM and by the single switch 13. FIG. 7 schematically shows part of a further embodiment in which an electronically commutated brushless motor (ECM) 61 is arranged in the shaver 1, the speed of which is controlled by a further processor 62. The ECM motor 61 comprises N coils 611, 612, 613 and N switches 615, 616, 617, with N being 3 or more. Note that FIG. 6 shows a simplified scheme and that the ECM motor 61 may have a wye or delta configuration. The further processor 62 is arranged to control the ECM motor 61 by sequentially switching the individual coils 611, 612, 613. Zero-passes of the coils 611, 612, 613 may be used to determine the speed of the motor 61 and control the switching, but this is not the most practical solution. A more robust and low-cost method to determine the power consumption of the ECM motor 61 is to measure the current into the motor 61 prior to, or after, the splitting of signals into the individual coils. Measurement point 64 and measurement point 65 indicate possible points where the load detector 14 may be arranged. Given the switching nature of the ECM motor 61, also in this embodiment, the low-pass filter described in FIG. 6 will help improve the operation of the shaver 1.

Instead of using a microprocessor/processor as discussed above, another type of circuitry could be used to control the voltage of the motor 2, such as switching banks of resistors or analog electronics, but such solutions will be less robust and more costly.

Alternatives may comprise a power supply arranged to switch between a high and a low DC average voltage level as a function of the measured value. In that case, the above mentioned 'average voltage level' is identical to the DC average voltage level.

It is noted that in this document the word 'comprising' does not exclude the presence of elements or steps other than those listed and the word 'a' or 'an' preceding an element does not exclude the presence of a plurality of such elements, and that any reference signs do not limit the scope of the claims. Furthermore, the invention is not limited to the embodiments, and the invention lies in each and every novel feature or combination of features described above or recited in mutually different dependent claims.

The invention claimed is:

1. An electric shaver comprising:

a cutter unit;

an electric motor arranged to drive the cutter unit;

a load detector arranged to measure at least one electric parameter indicative of a power consumption of the electric motor to obtain a measured value;

a memory;

an idle load calculator arranged to:

receive one or more measured values measured at different instances during an idle period of the shaver in which the shaver is switched on but not shaving;

calculate an idle load value using the one or more measured values;

store the calculated idle load value in the memory;

a threshold calculator arranged to:

read N idle load values from the memory relating to N previous shaving sessions, where N is a positive integer;

calculate a cleaning threshold value using the N idle load values;

a comparator arranged to receive the idle load value for a current shaving session, and generate a cleaning signal if the idle load value for the current shaving session exceeds the cleaning threshold value;

an alerter arranged to receive the cleaning signal from the comparator and produce an alert indicating to a user that the cutter unit of the shaver should be cleaned.

2. The electric shaver according to claim 1, wherein the comparator is arranged to generate a recalculate signal if the idle load value for the current shaving session does not exceed the cleaning threshold value, wherein the threshold calculator is arranged to receive the recalculate signal and, upon receipt thereof, read K idle load values from the memory relating to K previous shaving sessions, and recalculate the cleaning threshold value using the K idle load values, wherein K is a positive integer greater than N.

3. The electric shaver according to claim 1, wherein the idle load calculator is arranged to average the one or more measured values measured during the idle period of the shaver to obtain the idle load value.

4. The electric shaver according to claim 1, wherein the idle period of the shaver is a predetermined period starting when the electric motor is switched on.

5. The electric shaver according to claim 1, wherein the idle period of the shaver is a predetermined period starting at a point in time after the motor is switched on and after an initial start-up peak of the power consumption of the electric motor.

6. The electric shaver according to claim 1, wherein the shaver comprises a cleaning detector arranged to detect whether the cutter unit has been cleaned and, if so, send a reset signal to the threshold calculator.

7. The electric shaver according to claim 6, wherein the cleaning detector is arranged to compare the calculated idle load value of the current shaving session and the calculated idle load value of an immediately preceding shaving session with the cleaning threshold value, and send the reset signal to the threshold calculator if both the calculated idle load value of the current shaving session is lower than the cleaning threshold value and the calculated idle load value of the immediately preceding shaving session is above the cleaning threshold value.

8. The electric shaver according to claim 1, wherein the threshold calculator is arranged to calculate the cleaning threshold value using the formula $$CL_TH=(1+F)\times \mathrm{Aver}(N_\mathrm{idle_values})$$

wherein CL_TH corresponds to the cleaning threshold value

F is a factor in a range of 0.0-1.0

Aver( ) is an averaging function

N_idle_values corresponds to the N idle load values from the memory relating to N previous shaving sessions.

9. The electric shaver according to claim 8, wherein the factor F is in a range from 0.1 to 0.2.

10. The electric shaver according to claim 9, wherein the factor F is 0.12.

11. The electric shaver according to claim 1, wherein the shaver comprises a microprocessor comprising the idle load calculator, the threshold calculator and the comparator.

12. The electric shaver according to claim 1, wherein N is equal to 3.

13. The electric shaver according to claim 1, wherein the electric shaver is a razor or a trimmer.

* * * * *